US010801794B2

(12) United States Patent
Geissele

(10) Patent No.: US 10,801,794 B2
(45) Date of Patent: Oct. 13, 2020

(54) FIREARM TRIGGER SAFETY ASSEMBLY

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/384,238

(22) Filed: Apr. 15, 2019

(65) Prior Publication Data

US 2019/0242666 A1 Aug. 8, 2019

Related U.S. Application Data

(63) Continuation of application No. 15/281,203, filed on Sep. 30, 2016, now Pat. No. 10,317,158.

(51) Int. Cl.

| | |
|---|---|
| ***F41A 17/46*** | (2006.01) |
| ***F41A 19/10*** | (2006.01) |
| *F41A 19/14* | (2006.01) |

(52) U.S. Cl.

CPC ..... *F41A 17/46* (2013.01); *F41A 19/10* (2013.01); *F41A 19/14* (2013.01)

(58) Field of Classification Search

CPC ..... F41A 17/46; F41A 19/10; F41A 19/09; F41A 19/16

See application file for complete search history.

(56) References Cited

U.S. PATENT DOCUMENTS

| | | | | |
|---|---|---|---|---|
| 620,796 | A * | 3/1899 | Newell et al. | F41A 19/10 42/69.01 |
| 4,005,540 | A | 2/1977 | Robinson | |
| 5,105,569 | A | 4/1992 | Straitiff | |
| 5,741,996 | A * | 4/1998 | Ruger | F41A 3/66 89/196 |
| 5,881,485 | A * | 3/1999 | Milazzo | F41A 19/16 42/69.03 |
| 6,553,706 | B1 | 4/2003 | Gancarz et al. | |
| 6,843,013 | B2 * | 1/2005 | Cutini | F41A 17/46 42/70.01 |
| D597,625 | S | 8/2009 | Pflaumer et al. | |
| D597,626 | S | 8/2009 | Krieger | |

(Continued)

FOREIGN PATENT DOCUMENTS

| | | | | |
|---|---|---|---|---|
| WO | WO-9729337 A1 * | 8/1997 | | F41A 3/66 |

OTHER PUBLICATIONS

Glock Website, https://us.glock.com/technology/safe-action (Mar. 8, 2016).

*Primary Examiner* — Benjamin P Lee

(74) *Attorney, Agent, or Firm* — Fox Rothschild LLP

(57) ABSTRACT

The present disclosure provides a trigger assembly and related method for a firearm (e.g., an AR, SR-25, or M4 style rifle, or another type of firearm). The trigger assembly minimizes inadvertent discharge of the firearm by blocking the trigger from rearward pivoting until pressure is applied to the center portion of the trigger. The system and method employ a configuration wherein a camming surface is engaged with a machined portion of the lower receiver once the trigger assembly is connected to the lower receiver via a pivot that extends through the trigger assembly and at least a portion of the lower receiver.

18 Claims, 10 Drawing Sheets

(56) References Cited

U.S. PATENT DOCUMENTS

| | | | | |
|---|---|---|---|---|
| 8,220,193 | B1 | 7/2012 | Lynch | |
| 8,250,799 | B2 * | 8/2012 | Duperry | F41A 19/16 42/42.02 |
| 9,046,313 | B1 | 6/2015 | Lutton et al. | |
| 9,291,416 | B2 | 3/2016 | Wurkner | |
| 9,316,455 | B2 | 4/2016 | Hirschheiter | |
| 9,441,897 | B2 * | 9/2016 | Mather | F41A 11/00 |
| 9,696,104 | B1 | 7/2017 | Bloomfield | |
| 10,006,734 | B1 | 6/2018 | Findlay | |
| 10,175,019 | B1 * | 1/2019 | Al-Mutawa | F41A 17/64 |
| 2003/0213159 | A1 | 11/2003 | Cutini et al. | |
| 2010/0024273 | A1 | 2/2010 | Duperry et al. | |
| 2013/0340309 | A1 | 12/2013 | Lee | |
| 2014/0000578 | A1 | 1/2014 | Huang et al. | |
| 2015/0330734 | A1 | 11/2015 | Kolev et al. | |
| 2016/0187090 | A1 | 6/2016 | Mather et al. | |
| 2016/0187092 | A1 | 6/2016 | Mather et al. | |
| 2017/0003093 | A1 | 1/2017 | Spinner et al. | |

* cited by examiner

FIREARM TRIGGER SAFETY ASSEMBLY

CROSS-REFERENCE TO RELATED APPLICATION

This application is a continuation of U.S. patent application Ser. No. 15/281,203 filed Sep. 30, 2016, the disclosure of which is hereby incorporated by reference in its entirety.

BACKGROUND

It is desirable to prevent the accidental discharge of a firearm. Some known systems and methods include trigger guards and holstering systems that minimize the possibility that the trigger is activated (pivoted rearward) unintentionally. Some systems employ a mechanism that blocks the trigger from free rearward movement until a user's hand is holding the firearm. Other systems employ a mechanism that blocks the trigger from free rearward movement until a user's finger is on the trigger and applies pressure thereto. The present invention relates to the latter type of system.

SUMMARY

The present disclosure provides a trigger assembly and related method for a firearm (e.g., an AR, SR-25, or M4 style rifle, or another type of firearm). The trigger assembly minimizes inadvertent discharge of the firearm by blocking the trigger from rearward pivoting until pressure is applied to the center portion of the trigger. The system and method employ a configuration wherein a camming surface is engaged with a machined portion of the lower receiver once the trigger assembly is connected to the lower receiver via pivot that extends through the trigger assembly and at least a portion of the lower receiver.

In one aspect, a lower receiver and trigger assembly comprises a trigger mechanism including: a trigger body, the trigger body including a downwardly extending finger engaging trigger member portion, wherein the downwardly extending finger engaging trigger member portion includes an upper portion, a middle portion, and a lower portion; a paddle release that extend downwardly through a portion of the finger engaging trigger member portion, the paddle release including: a pivot located at the upper portion of the finger engaging trigger member; a finger engaging leading edge portion; and a camming surface located above and rearward of the pivot; wherein the paddle release includes a depressed orientation; and wherein the camming surface is configured to engage the lower slot in the receiver when the paddle release is not in the depressed orientation. In another aspect, the lower receiver and trigger assembly further comprises a plunger engaging surface that is adjacent the camming surface located above the pivot, and a spring loaded plunger positioned within the trigger body configured to engage the plunger engaging surface to bias the paddle release in a forward counter clockwise direction. In another aspect, the paddle release includes an undepressed orientation, wherein in the undepressed orientation the finger engaging leading edge portion is forward of the leading edge of the downwardly extending finger engaging trigger member portion of the trigger body. In another aspect, the paddle release extends through the upper portion and middle portion of the downwardly extending finger engaging trigger member portion. In another aspect, the finger engaging leading edge portion of the paddle release extends forward of the leading edge of the downwardly extending finger engaging trigger member portion of the trigger body in the middle portion of the downwardly extending finger engaging trigger member portion. In another aspect, the finger engaging leading edge portion of the paddle release extends forward of the leading edge of the downwardly extending finger engaging trigger member portion of the trigger body only in the middle portion of the downwardly extending finger engaging trigger member portion. In another aspect, the paddle release includes an upper edge located above the finger engaging leading edge portion, wherein the upper edge and the downwardly extending finger engaging trigger member portion define an angle that is between 70-110 degrees. In another aspect, the paddle release includes a lower edge located below the finger engaging leading edge portion, wherein the lower edge and the downwardly extending finger engaging trigger member portion define an angle that is between 70-110 degrees. In another aspect, the pivot range of the trigger body is limited to less than 5 degrees until paddle release is in a depressed orientation.

In a further aspect, a trigger assembly comprises: a trigger body, the trigger body including a downwardly extending finger engaging trigger member portion; a paddle release that extend downwardly through a portion of the finger engaging trigger member portion, the paddle release including: a pivot located at an upper portion of the finger engaging trigger member; a finger engaging leading edge portion; a camming surface located above and rearward of the pivot; and a curved plunger engaging surface that is located above the pivot adjacent to the camming surface. In another aspect, the camming surface of the paddle release is about 1 mm to about 4 mm long. In another aspect, the trigger assembly further comprises a spring loaded plunger positioned within the trigger body configured to engage the curved plunger engaging surface to bias the paddle release in a forward counter clockwise direction. In another aspect, the spring loaded plunger is configured to be in constant sliding contact with the plunger engaging surface of the paddle release. In another aspect, the paddle release is configured to resist movement from for, from above, and force from below while pivot due to force in the trigger pull direction. In another aspect, the travel of the curved finger engaging leading edge portion of the paddle release from an undepressed position to a depressed position is greater than 3 mm. In another aspect, the paddle release is configured to limit the pivot range of the trigger body by a consistent amount until the paddle release is in a fully depressed orientation and allow the trigger body to pivot freely once the paddle release is in the fully depressed orientation.

In a further aspect, a method of assembling a firearm comprises the steps of: inserting a trigger assembly into a lower receiver such that a downwardly extending finger engaging trigger member portion extends through a trigger receiving slot; wherein the step of inserting the trigger assembly into the lower receiver engages a camming surface of a paddle release with a portion of the trigger receiving slot; wherein the paddle release is pivotally connected to the downwardly extending finger engaging trigger member portion and extends downwardly through a portion of the finger engaging trigger member portion; extending a pivot pin through the trigger assembly to secure a portion of the lower receiver. In another aspect, the step of extending the pivot pin through the trigger assembly automatically engages the camming surface with the portion of the trigger receiving slot.

DETAILED DESCRIPTION

Figure 1:
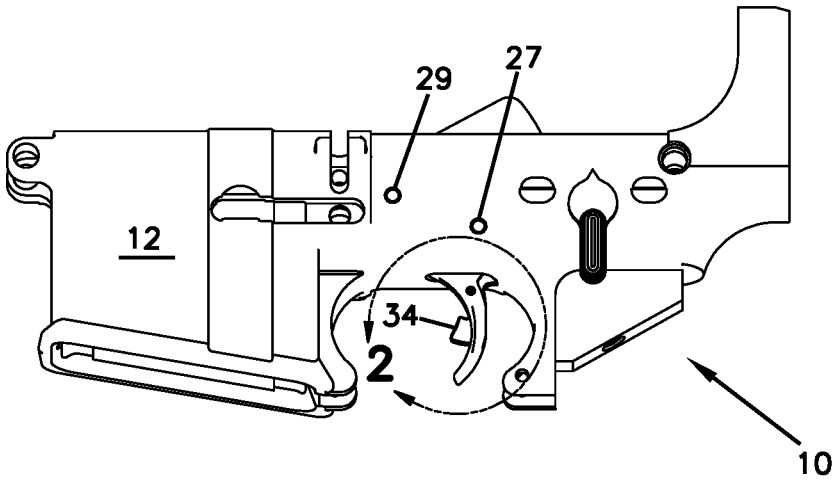
FIG. 1 is an elevation view of a trigger assembly according to the present disclosure in a first orientation.
Figure 2:
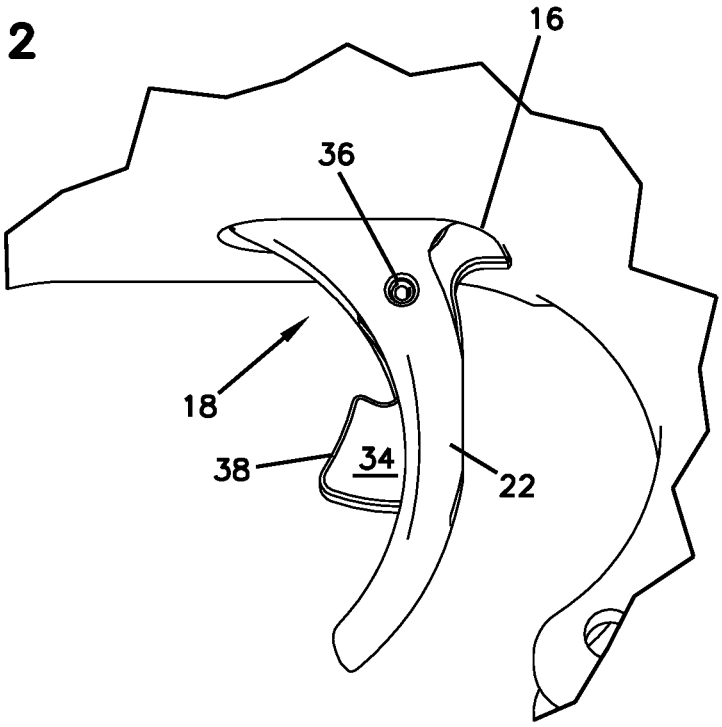
FIG. 2 is an enlarged view of a portion of FIG. 1.
Figure 3:
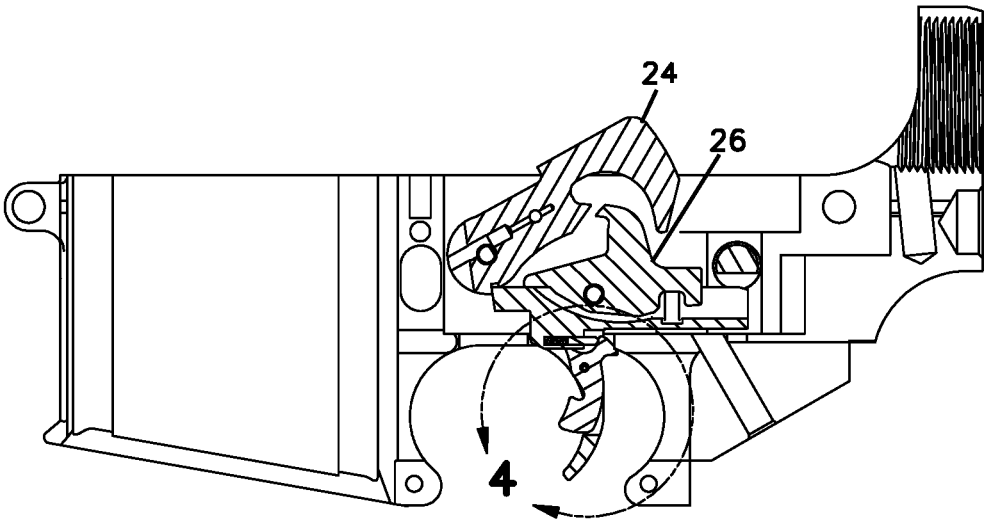
FIG. 3 is a cross-sectional view of FIG. 1.
Figure 4:
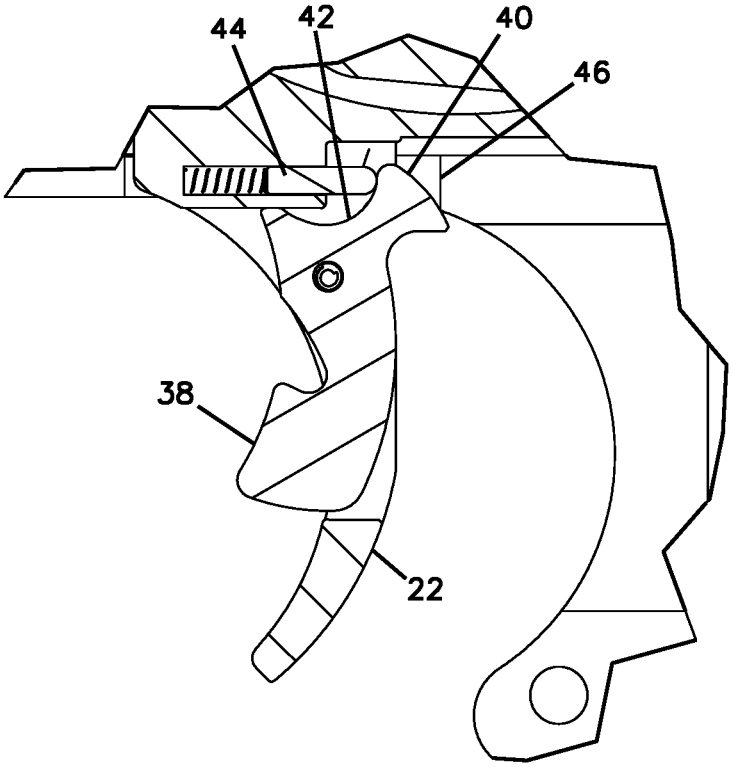
FIG. 4 is a cross-sectional view of FIG. 2.
Figure 5:
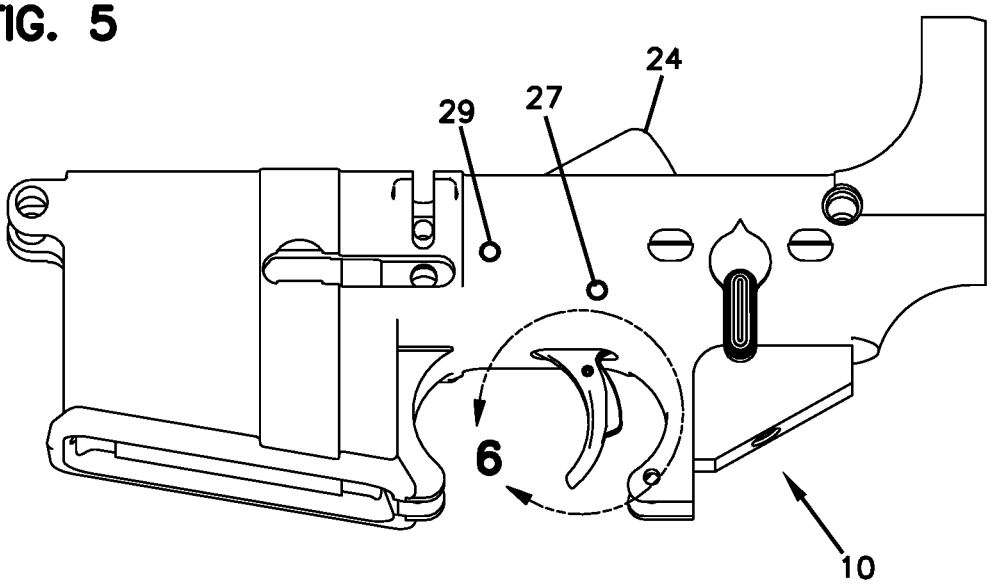
FIG. 5 is an elevation view of the trigger assembly of FIG. 1 in a second orientation.
Figure 6:
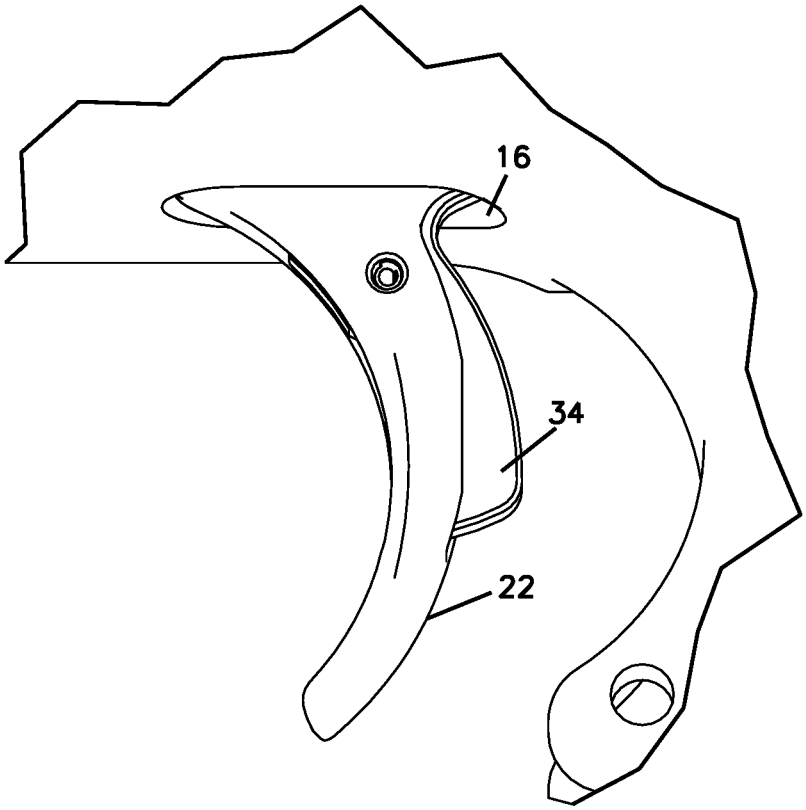
FIG. 6 is an enlarged view of a portion of FIG. 5.
Figure 7:
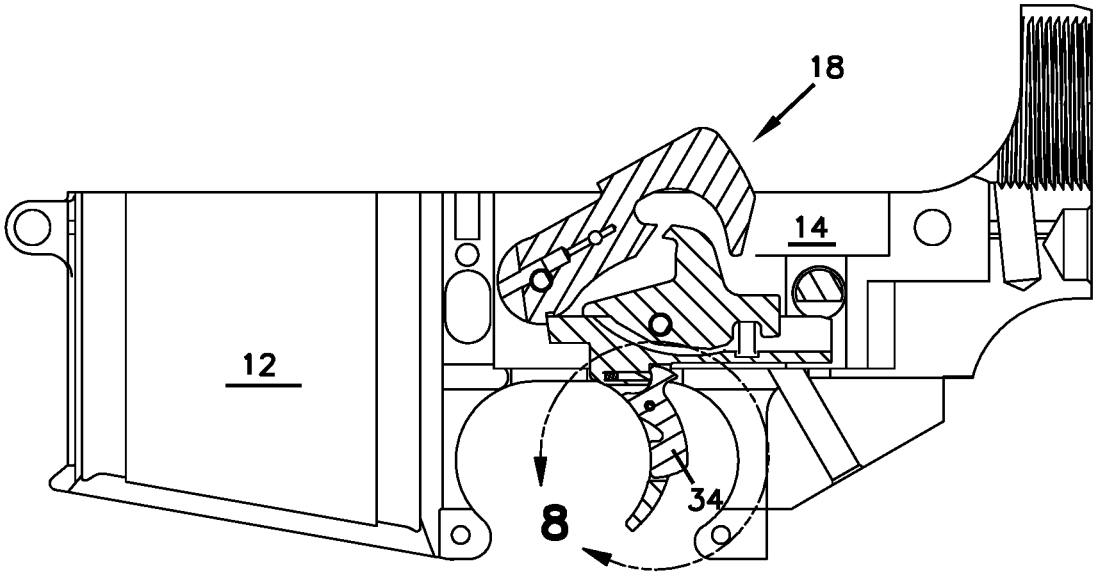
FIG. 7 is a cross-sectional view of FIG. 5.
Figure 8:
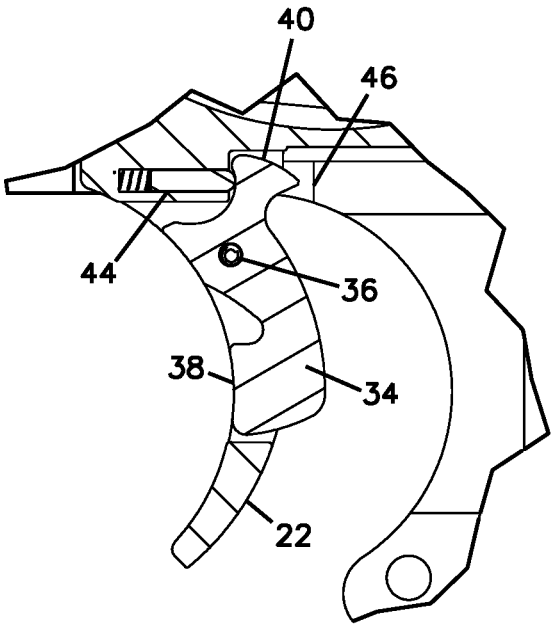
FIG. 8 is a cross-sectional view of FIG. 6.
Figure 9:
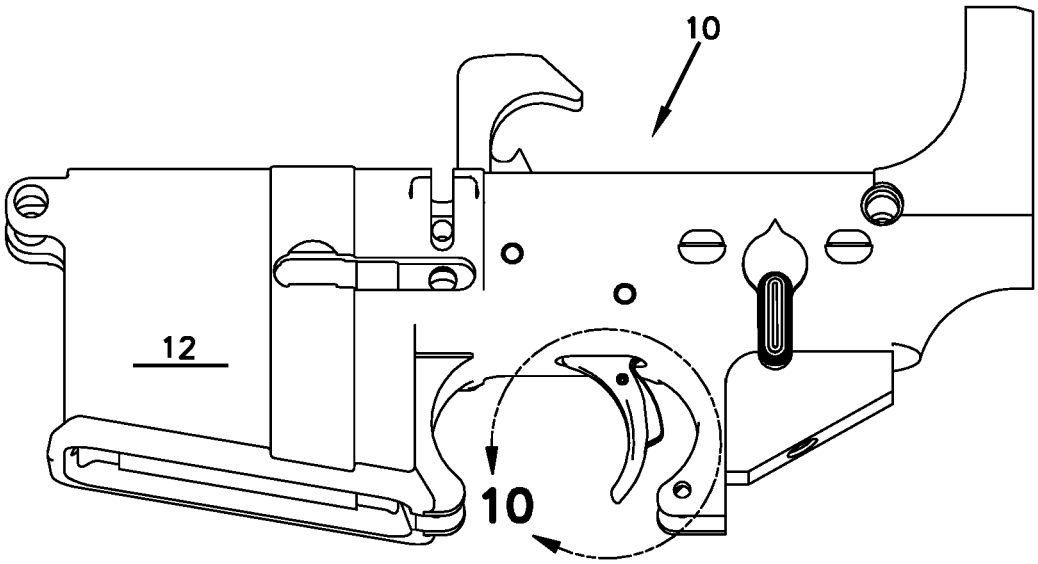
FIG. 9 is an elevation view of the trigger assembly of FIG. 1 in a third orientation.
Figure 10:
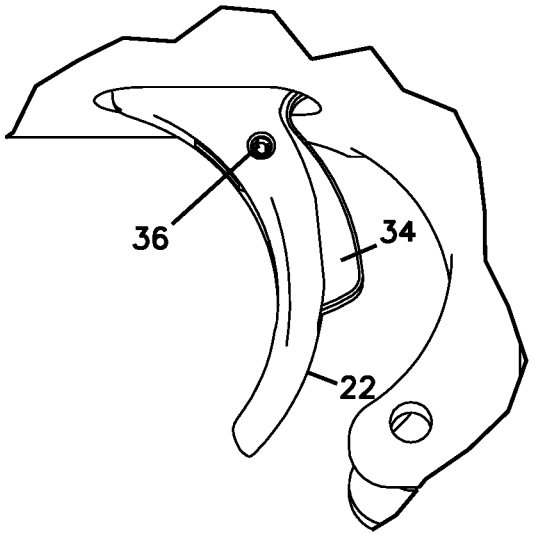
FIG. 10 is an enlarged view of a portion of FIG. 9.
Figure 11:
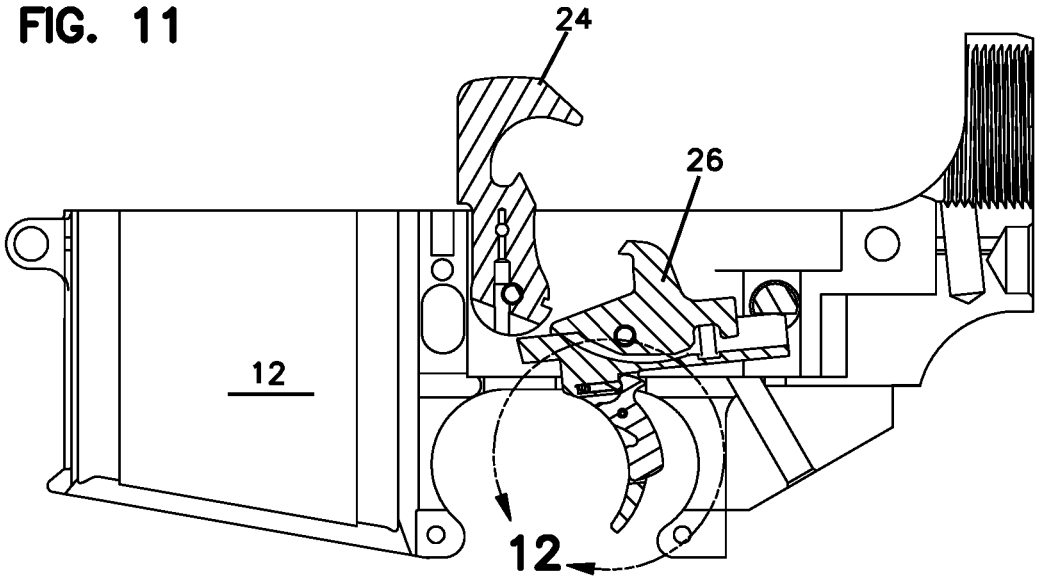
FIG. 11 is a cross-sectional view of FIG. 9.
Figure 12:
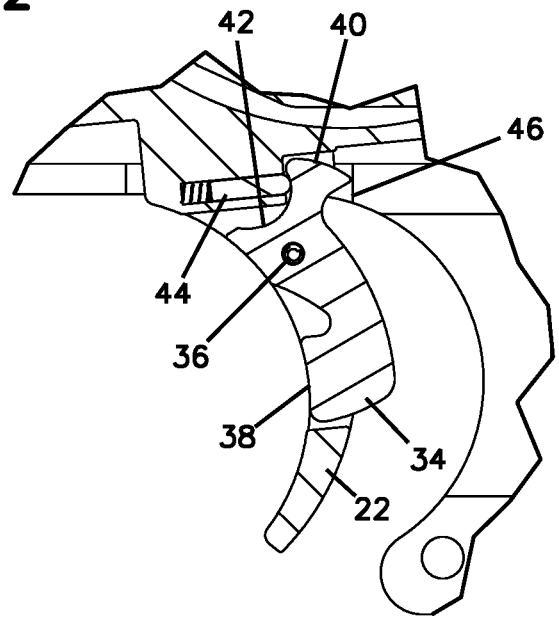
FIG. 12 is a cross-sectional view of FIG. 10.
Figure 13:
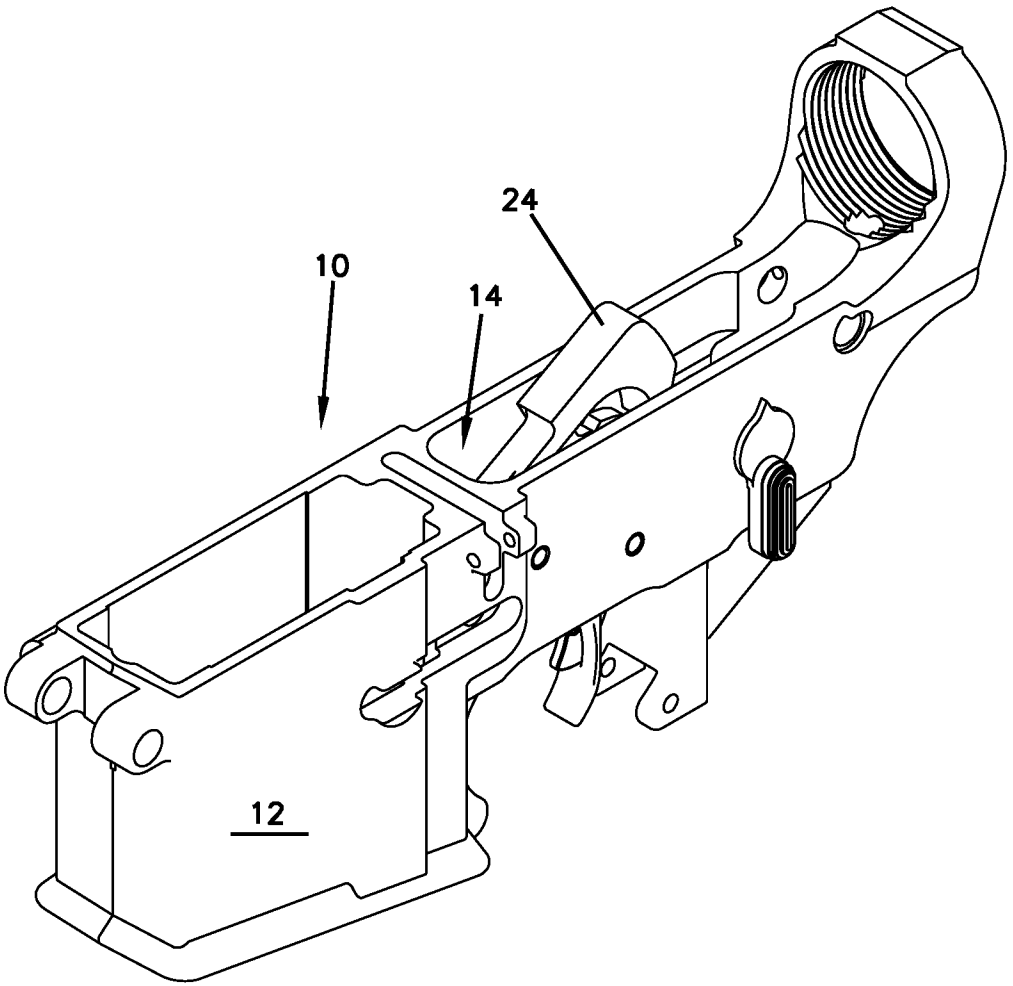
FIG. 13 is a top perspective view of the trigger assembly of FIG. 1.
Figure 14:
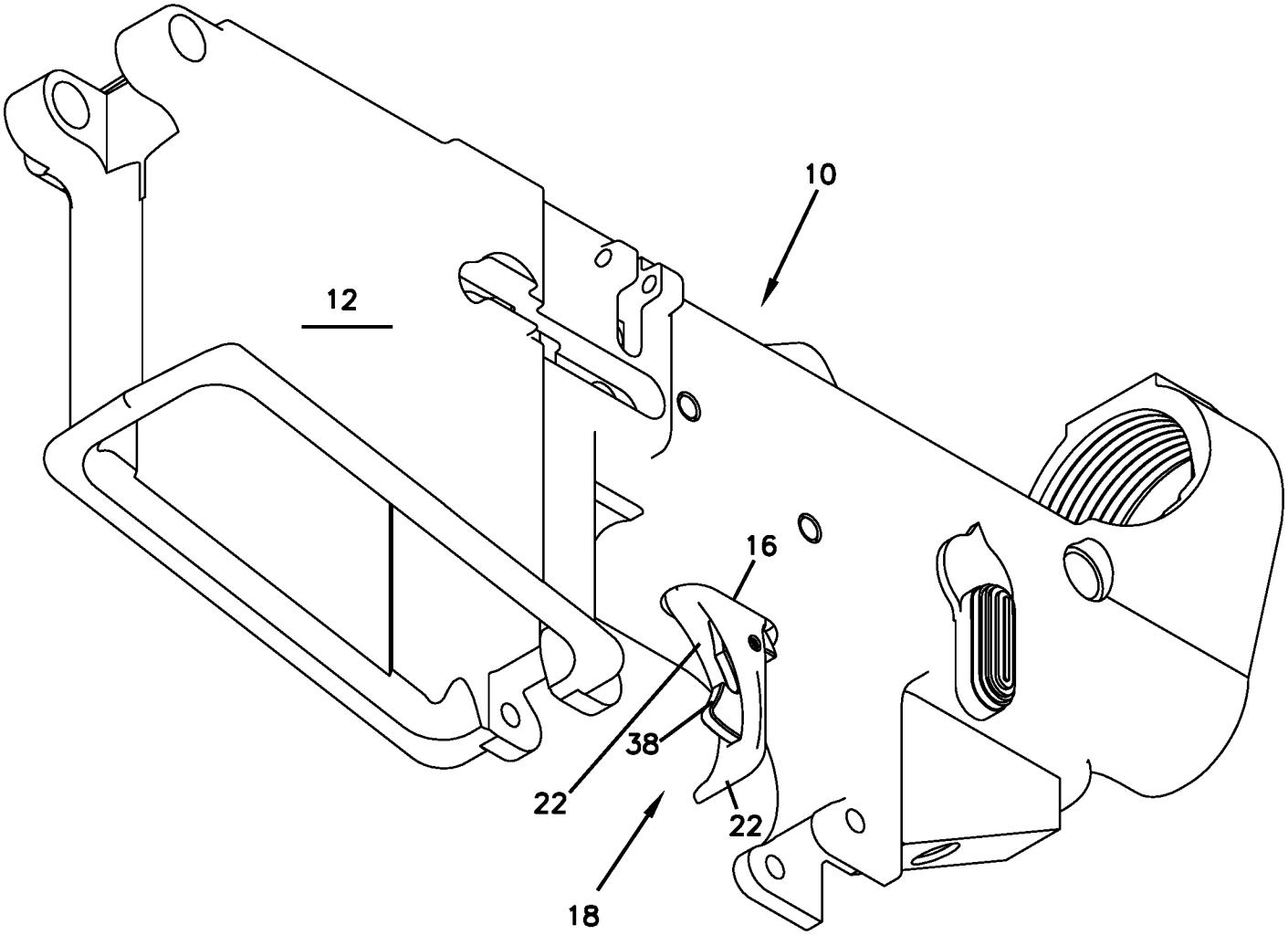
FIG. 14 is a bottom perspective view of the trigger assembly of FIG. 1.
Figure 15:
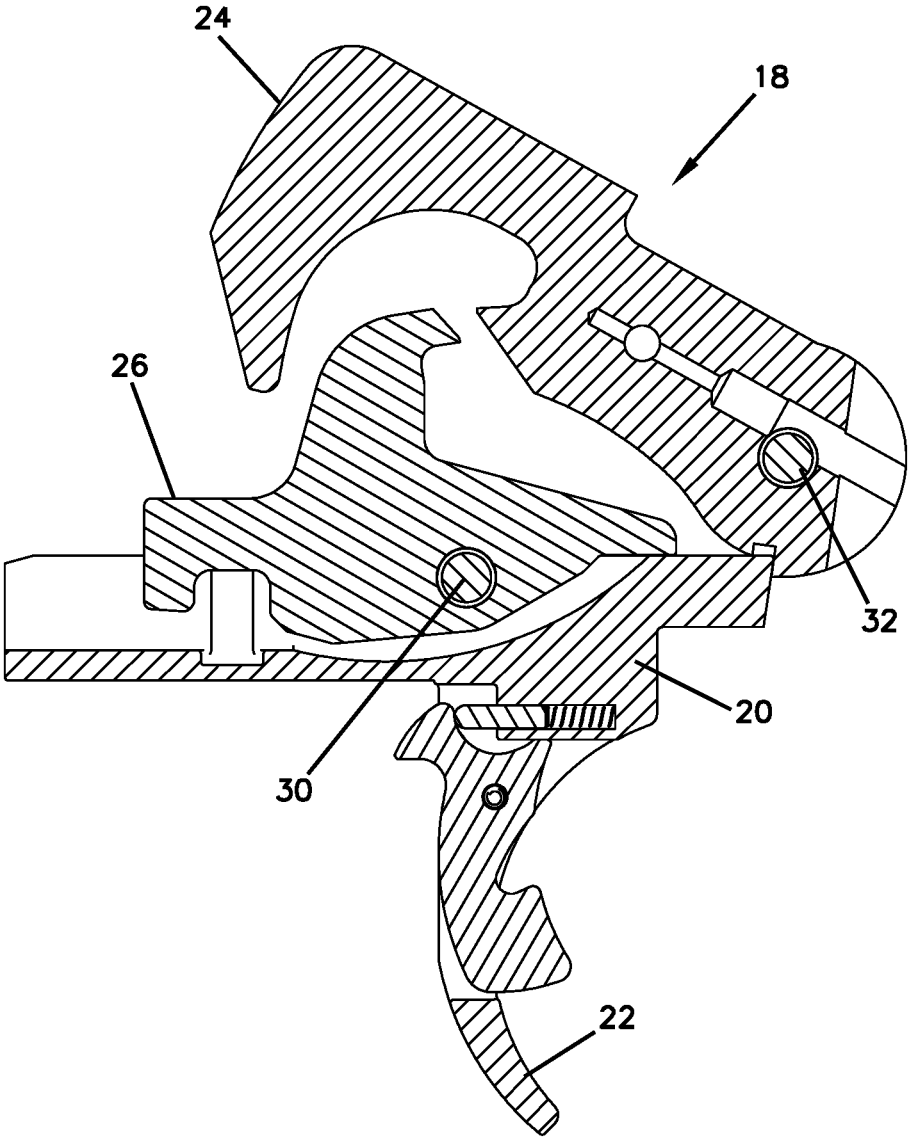
FIG. 15 is a cross-sectional view of the trigger assembly of FIG. 1.
Figure 16:
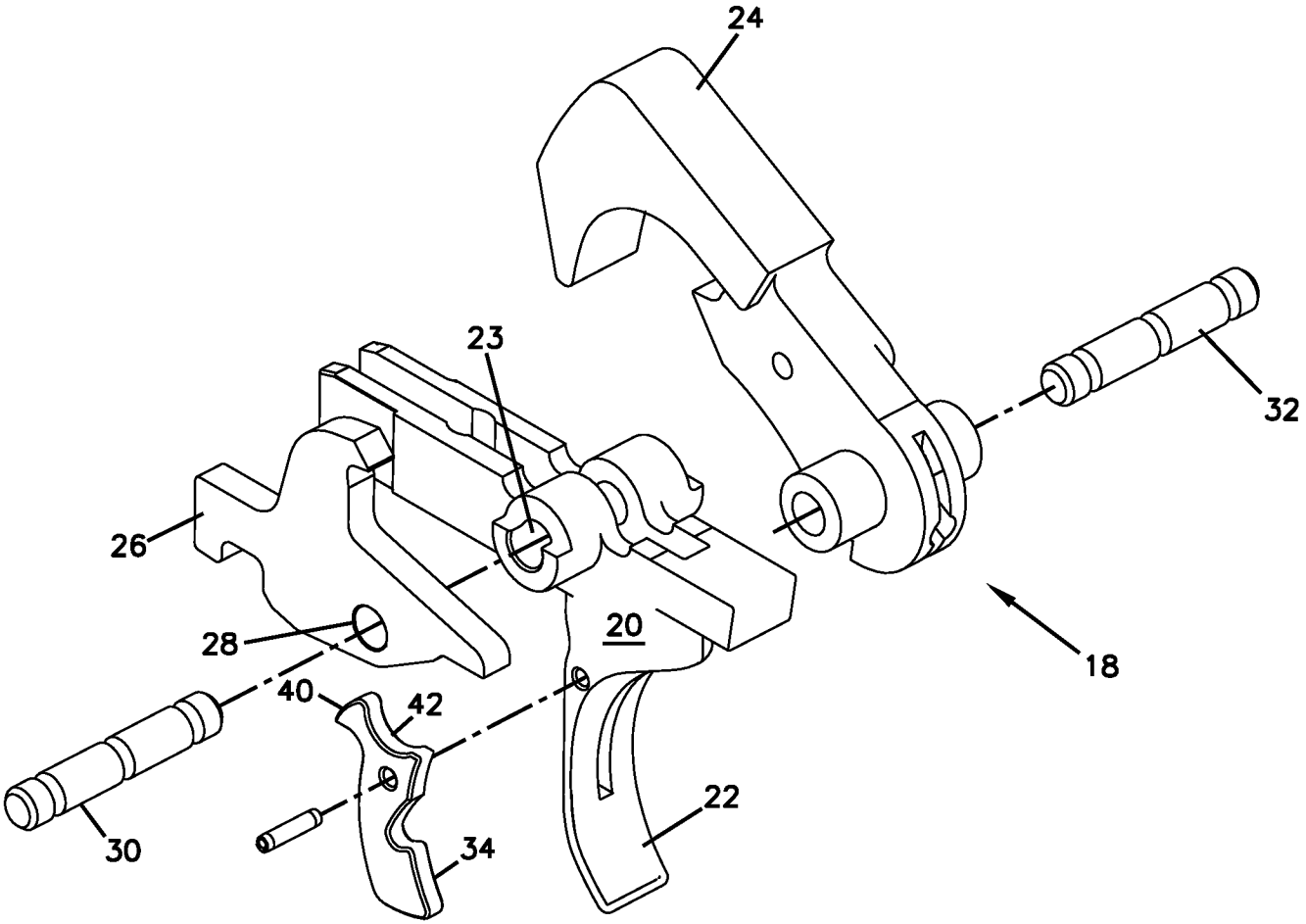
FIG. 16 is an exploded assembly view of the trigger assembly of FIG. 1.

Referring to the figures, a trigger assembly according to the present disclosure is described in further detail. In the depicted embodiment, the trigger assembly is for a firearm. The trigger assembly, also referred to as a trigger mechanism 18, is configured to fit to a lower receiver 10 of a firearm. In the depicted embodiment, the lower receiver is constructed of forged aluminum. In the depicted embodiment, the forged lower receiver 10 has a magazine well 12 and a cavity 14 for receiving a trigger mechanism 18. In the depicted embodiment, the cavity for receiving a trigger mechanism 18 includes a machined lower slot 16. It should be appreciated that many alternative receiver configurations are possible. It should be appreciated that many other lower receiver configurations are possible including, for example, machined lower metal receivers and lower receivers that are printed or molded from polymeric or metal materials.

In the depicted embodiment, the trigger mechanism 18 includes a trigger body 20. The trigger body includes a downwardly extending curved finger engaging trigger member portion 22. The downwardly extending curved finger engaging trigger member portion 22 includes an upper portion, a middle portion, and a lower portion. It should be appreciated that many alternative configurations are possible. For example, in an alternative embodiment the finger engaging trigger member could be straight, angled, etc.

In the depicted embodiment, the trigger mechanism 18 includes a disconnector 26 nested within the trigger body 20. The disconnector 26 is pivotally connected to the trigger body 20 by a trigger pin 30 that extends through an aperture 23 of the trigger body, an aperture 28 in the disconnector 26 and an aperture 27 in the lower receiver 10. It should be appreciated that many other configurations are also possible including some that do not include the above-described disconnector.

In the depicted embodiment, the trigger mechanism 18 includes a hammer 24 that is selectively engaged with the disconnector 26. After the hammer 24 is released when the finger engaging trigger member 22 is pulled in a rearward clockwise direction, the disconnector engages the hammer and returns the hammer to its redeployed position to reset the hammer. In the depicted embodiment, the hammer 24 is pivotally connected to the receiver 10 via a hammer pin 32 that extends through the hammer 24 and an aperture 29 in the receiver. It should be appreciated that many other configurations are also possible including some that do not include the above-described hammer.

In the depicted embodiment, the trigger mechanism 18 includes a paddle release 34 that extends downwardly through a portion of the finger engaging trigger member portion 22. In the depicted embodiment, the paddle release 34 includes a pivot 36 located at the upper portion of the finger engaging trigger member 22. The paddle release 34 is configured to block the finger engaging trigger member 22 from rotating in the firing direction (clockwise) until the paddle release 34 is depressed. In the depicted embodiment, the pivot range of the trigger body 20 is limited to prevent the hammer 24 from deploying and thereby firing the weapon until the paddle release 34 is in the depressed orientation. In the depicted embodiment, the pivot range of the trigger body 20 is limited to less than five degrees until paddle release 34 is in a depressed orientation. In the depicted embodiment, the paddle release 34 is configured to limit the pivot range of the trigger body 20 by a consistent amount until the paddle release 34 is in a fully depressed orientation and allow the trigger body 20 to pivot freely once the paddle release 34 is in the fully depressed orientation.

In the depicted embodiment, the paddle release 34 also includes an undepressed orientation. In the undepressed orientation, the curved finger engaging leading edge portion 38 is forward of the leading edge of the downwardly extending curved finger engaging trigger member portion 22 of the trigger body 20. In the depicted embodiment, the travel of the curved finger engaging leading edge portion 38 of the paddle release 34 from an undepressed position to a depressed position is greater than 3 mm.

In the depicted embodiment, the paddle release 34 includes a curved finger engaging leading edge portion 38. The curved finger engaging leading edge portion 38 is configured to engage the user's trigger finger. In the depicted embodiment, the paddle release 34 extend through the upper portion and middle portion of the downwardly extending curved finger engaging trigger member portion 22 of the trigger body 20. The curved finger engaging leading edge portion 38 of the paddle release extends forward of the leading edge of the downwardly extending curved finger engaging trigger member portion 22 of the trigger body 20 in the middle portion of the downwardly extending curved finger engaging trigger member portion 22. It should be appreciated that many alternative configurations are possible. For example, in an alternative embodiment the leading edge portion need not be curved.

In the depicted embodiment, the curved finger engaging leading edge portion 38 of the paddle release 34 extends forward of the leading edge of the downwardly extending curved finger engaging trigger member portion 22 of the trigger body 20 only in the middle portion of the downwardly extending curved finger engaging trigger member portion 22. In the depicted embodiment, the paddle release 34 is configured to resist movement from above and force from below the pivot due to force applied in the trigger pull direction. In the depicted embodiment, the paddle release 34 includes an upper edge located above the curved finger engaging leading edge portion 22. In the depicted embodiment, the upper edge and the downwardly extending curved finger engaging trigger member portion 22 define an angle that is between 70-110 degrees. In the depicted embodiment, the paddle release 34 includes a lower edge located above the curved finger engaging leading edge portion 38. The lower edge and the downwardly extending curved finger engaging trigger member portion 22 define an angle that is between 70-110 degrees.

In the depicted embodiment, the paddle release 34 includes a camming surface 40 located above and rearward of the pivot 36. In the depicted embodiment, the camming surface 40 has a continuously curved profile that is 1 mm to 4 mm long. In the depicted embodiment, the camming surface 40 is configured to engage a machined portion 46 of the machined lower slot in the receiver. In the depicted embodiment, the paddle release 34 includes a curved plunger 42 engaging surface that is adjacent to the camming surface 40 located above the pivot 36. It should be appreciated that alternative configurations are possible. For example, the camming surface 40 could have a faceted profile with a number of connected flat straight surfaces as opposed to having a continuously curved profile.

In the depicted embodiment, the trigger mechanism 18 includes a spring loaded plunger 44 positioned within the trigger body 20 configured to engage the curved plunger engaging surface to bias the paddle release 34 in a forward counter clockwise direction. In the depicted embodiment, the paddle release 34 includes a depressed orientation. In the depressed orientation 34, the curved finger engaging leading edge portions 38 is flush with the leading edge of the downwardly extending curved finger engaging trigger member portion 22 of the trigger body 20.

In one embodiment, wherein the spring loaded plunger is configured to be in constant sliding contact with the plunger engaging surface of the paddle release. It should be appreciated that many other alternative configurations could be used to bias the paddle release 34 in the forward counter-clockwise direction.

A method of assembling a rifle is also provided. In the depicted embodiment, the method includes the steps of inserting trigger assembly into a lower receiver such that a downwardly extending curved finger engaging trigger member portion 22 extends through a machined trigger receiving slot. The step of inserting the trigger assembly into the lower receiver engages a camming surface 44 of a paddle release 34 with a machined portion of the trigger receiving slot. In the depicted embodiment, the paddle release 32 is pivotally connected to the downwardly extending curved finger engaging trigger member portion 22 and extends downwardly through a portion of the finger engaging trigger member portion 22. In the depicted embodiment, the method also includes the step of extending a pivot pin through the trigger assembly to secure a portion of the lower receiver. In the depicted embodiment, the step of extending the pivot pin through the trigger assembly automatically engages the camming surface with the machined portion of the trigger receiving slot.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A trigger assembly, comprising:

a trigger body, the trigger body including a downwardly extending finger engaging trigger member portion;

a paddle release that extends downwardly through a portion of the finger engaging trigger member portion, the paddle release including:

a pivot located at an upper portion of the finger engaging trigger member;

a finger engaging leading edge portion;

a rotary camming surface located above and rearward of the pivot, wherein the rotary camming surface is configured to engage a surface when the paddle release is not in a depressed orientation, and wherein the trigger assembly is configured such that, if the downwardly extending finger engaging trigger member portion is depressed until a pivoting motion of the downwardly extending finger engaging trigger member portion is blocked by the rotary camming surface, the paddle release may then be depressed from an undepressed orientation without changing the orientation of the blocked downwardly extending finger engaging trigger member portion.

2. The trigger assembly of claim 1, further comprising:

a plunger engaging surface adjacent the rotary camming surface located above the pivot, and a biased plunger positioned within the trigger body and configured to engage the plunger engaging surface to bias the paddle release in a forward direction.

3. The trigger assembly of claim 2, wherein the plunger engaging surface is curved and located above the pivot adjacent to the rotary camming surface.

4. The trigger assembly of claim 1, wherein the paddle release includes an undepressed orientation, wherein in the undepressed orientation the finger engaging leading edge portion is forward of the leading edge of the downwardly extending finger engaging trigger member portion of the trigger body.

5. The trigger assembly of claim 1, wherein the paddle release extends through the upper portion and middle portion of the downwardly extending finger engaging trigger member portion.

6. The trigger assembly of claim 1, the finger engaging leading edge portion of the paddle release extends forward of the leading edge of the downwardly extending finger engaging trigger member portion of the trigger body in the middle portion of the downwardly extending finger engaging trigger member portion.

7. The trigger assembly of claim 1, the finger engaging leading edge portion of the paddle release extends forward of the leading edge of the downwardly extending finger engaging trigger member portion of the trigger body only in the middle portion of the downwardly extending finger engaging trigger member portion.

8. The trigger assembly of claim 1, wherein the paddle release includes an upper edge located immediately above the finger engaging leading edge portion, wherein the upper edge and the downwardly extending finger engaging trigger member portion define an angle of 70-110 degrees.

9. The trigger assembly of claim 1, wherein the paddle release includes a lower edge located immediately below the finger engaging leading edge portion, wherein the lower edge and the downwardly extending finger engaging trigger member portion define an angle of 70-110 degrees.

10. The trigger assembly of claim 1, wherein the pivot range of the trigger body is limited to less than 5 degrees until the paddle release is in a depressed orientation.

11. The trigger assembly of claim 1, wherein the rotary camming surface of the paddle release is about 1 mm to about 4 mm long.

12. The trigger assembly of claim 1, further comprising a biased plunger positioned within the trigger body and configured to engage the plunger engaging surface to bias the paddle release in a forward direction.

13. The trigger assembly of claim 12, wherein the biased plunger is configured to be in constant sliding contact with the plunger engaging surface.

14. The trigger assembly of claim 1, wherein the paddle release is configured to resist movement from above and force from below the pivot due to force applied in the trigger pull direction.

15. The trigger assembly of claim 1, wherein the travel of the finger engaging leading edge portion of the paddle release from an undepressed position to a depressed position is greater than 3 mm.

16. The trigger assembly of claim 1, wherein the paddle release is configured to limit the pivot range of the trigger body by a consistent amount until the paddle release is in a fully depressed orientation and allow the trigger body to pivot freely once the paddle release is in the fully depressed orientation.

17. A firearm comprising the trigger assembly of claim 1.

18. The trigger assembly of claim 1, wherein the rotary camming surface has a faceted profile comprising connected flat straight surfaces.

* * * * *